United States Patent [19]

Chen

[11] Patent Number: 4,742,594

[45] Date of Patent: May 10, 1988

[54] BLACKBOARD ERASER

[76] Inventor: Jin-Sheng Chen, 34 Ching-Yuen Street, Tsao-Tuen, Nantou Hsein, Taiwan

[21] Appl. No.: 904,352

[22] Filed: Sep. 5, 1986

[51] Int. Cl.[4] ..... A47L 13/38; B43L 21/00

[52] U.S. Cl. ..... 15/98; 15/27; 15/97 R; 15/221; 434/417

[58] Field of Search ..... 15/97 R, 98, 23, 24, 15/210 R, 27; 434/417

[56] References Cited

U.S. PATENT DOCUMENTS

| | | | |
|---|---|---|---|
| 1,487,052 | 3/1924 | Enomoto | 15/210 R |
| 4,080,683 | 3/1978 | Yi | 15/98 |
| 4,462,134 | 7/1984 | Wang | 15/98 |
| 4,596,059 | 6/1986 | Lee | 15/98 |

FOREIGN PATENT DOCUMENTS

| | | | |
|---|---|---|---|
| 2090123 | 7/1982 | United Kingdom | 15/210 R |

*Primary Examiner*—Edward L. Roberts
*Attorney, Agent, or Firm*—Bucknam and Archer

[57] ABSTRACT

An improved blackboard eraser used for automatically erasing the chalk dust comprises a housing, in which several sets of brushes and rollers in number corresponding to the brushes are installed. The rollers are made of suitable chalk-erasing material and the bottom contacts the brushes, so that the brushes can erase the chalk dust on the rollers, then they let the chalk drop down into the trough, when the rollers are rotating. This method avoids the chalk dust flying in the air. The gear means are installed on each side of the rollers. Furthermore, the gear means are connected with the idle gears on two sides of the housing to form a gear system. The RPM between the rollers are different due to the different number of the gear teeth between the gear means and the idle gears; then a friction effect is generated because of the different speeds between them, so that the erasing effect for the blackboard is improved.

2 Claims, 3 Drawing Sheets

BLACKBOARD ERASER

This invention relates to a blackboard eraser and more particularly to an improved blackboard eraser which can automatically erase the chalk dust, wherein there is a different rotating speed between the rollers. Using the friction effect generated between them, the blackboard may be better erased.

BACKGROUND OF THE INVENTION

The traditional blackboard eraser is composed of cotton cloth. The most serious problem lies in the fact that the chalk dust flies in the air during the erasing. Moreover, the excess chalk dust adheres to the chalk eraser and not only is it difficult to clean it, but more chalk dust will be flying in the air during the cleaning. Therefore, the air will be polluted with harm to human health. The electric blackboard eraser has been proposed which has solved the defect of cleaning chalk dust, but it is not economical because of heavy equipment and energy requirement and is not popular. On Mar. 28, 1982 Mr. Chong Sun Yi received the U.S. Pat. No. 4,080,683 for Chalk Board Eraser and the blackboard eraser has obviously been improved. In this invention, the rollers are used for erasing the blackboard chalk dust. Moreover, there are brushes on one side of the rollers. When the rollers are erasing the blackboard, the brushes brush the chalk dust into a closed container. Furthermore, the gear system is installed on one side of the rollers for the purpose of providing means for slowing the rotational speed of the roller, so that there is sliding between the roller and the chalkboard, when the eraser is moved across the chalkboard in a direction transverse to the roller axle. The drawback of the above-mentioned device lies in the fact that there is only one piece roller. Furthermore, the case is triangular, and the roller is located at one angle of the triangle. Therefore, when it is used, the force is not distributed equally and the eraser is not stationary. In addition, Mr. Pang Hiang Seng has received U.S. patent Ser. No. 8,039,382 for Blackboard Duster, which uses two rollers, and a piece of a dusting member is installed between two rollers and passes over two rollers. It uses a dusting member as the erasing tool so that the contact area becomes larger. When the blackboard is erased, the dusting member can erase only the blackboard due to no special design for the rollers, so that it has no sliding effect as shown in U.S. Pat. No. 4,080,683, and it has no good erasing effect. One feature of the present invention lies in the fact that a movable receptacle is installed on one side of the box, and a swing door connected by a hinge element is installed between the receptacle and box. It can be opened only in one direction.

SUMMARY OF THE INVENTION

In accordance with the preferred embodiment of the invention, three rollers used for erasing the blackboard are installed on the housing. A brush used for erasing the chalk dust is fixed under each roller, and the gears are installed on two sides of the rollers. Moreover, the gears at the end of the roller axle are connected with the idle pulley located between two sides of the housing. The number of the gear teeth is different. Using their different transmission speed, a larger friction force can be generated, so that the blackboard can be better erased.

BRIEF DESCRIPTION OF THE DRAWINGS

The foregoing and other objects are attained by means described herein and disclosed in the accompanying drawings in which.

BRIEF DESCRIPTION OF THE PREFERRED EMBODIMENT

Figure 1:
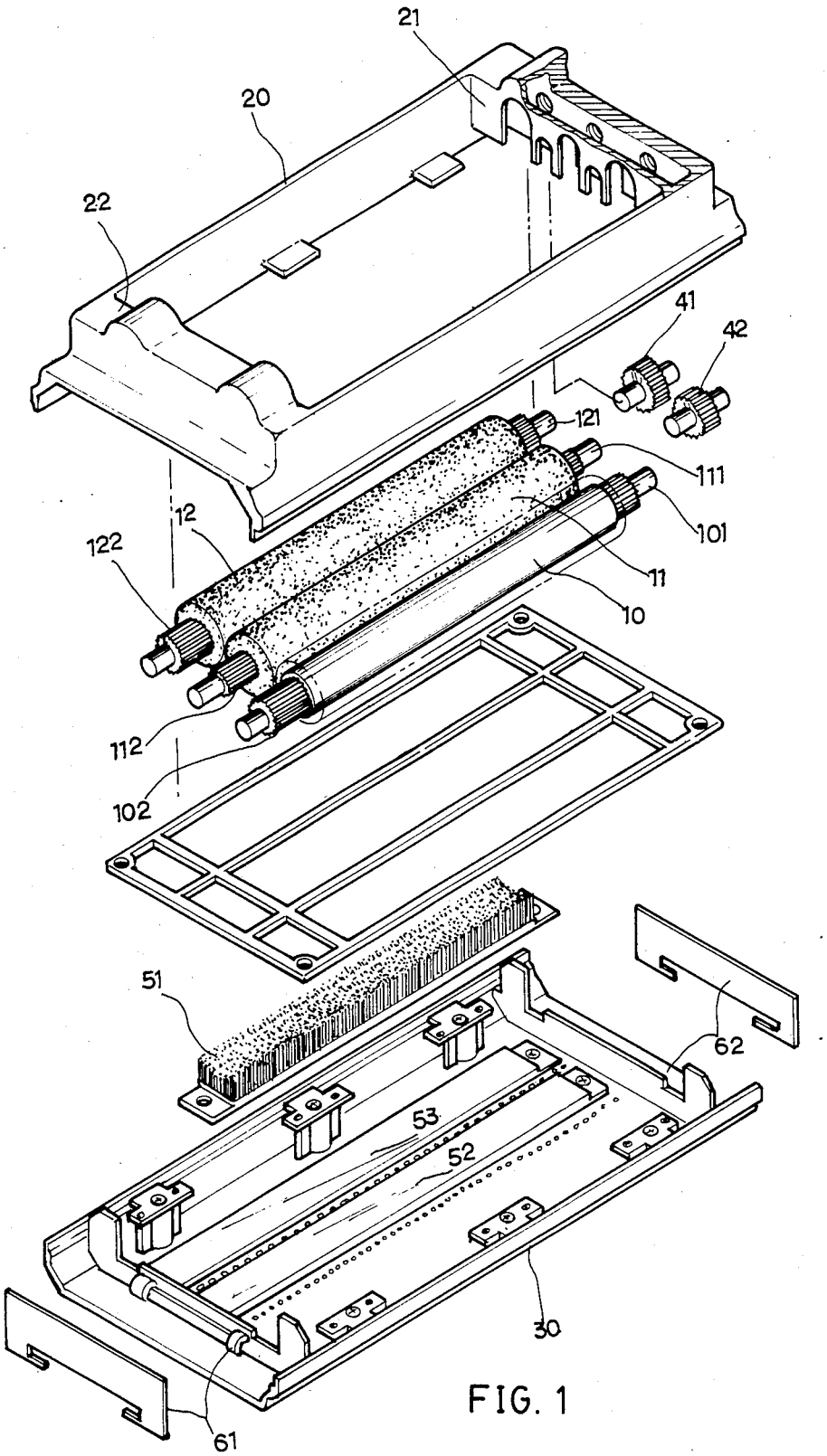
FIG. 1 is a perspective view in elevation of an improved blackboard eraser showing the different components separately.
Figure 2:
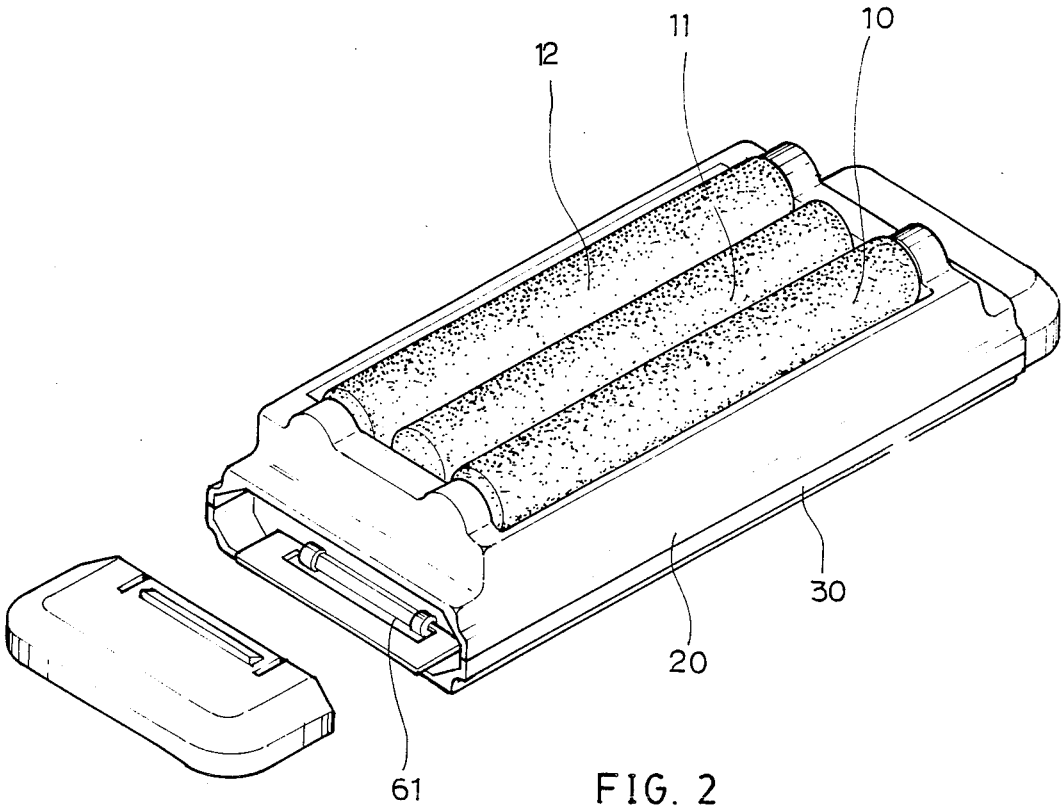
FIG. 2 is a perspective view showing the elements combined together.

As shown in the figures, the eraser of the present invention comprises a base (30), a cover (20) located on the base (30), three erasing rollers (10) wherein each is respectively and rotatably mounted within cover (20). Gears (101) (102)(121)(122) withsame number of the gear teeth are installed respectively on two ends of first and third rollers (10)(12), and the gears (111)(112) with a smaller number of gear teeth are installed at two ends of the second roller (11) located between the first and the third rollers (10)(12). The sponge suitable for erasing the blackboard covers the rollers and the surface of the sponges is treated to roughen it to increase the friction effect. The axle parts located at the two ends of the rollers (10)(11)(12) penetrate the two sides of the cover (20), and the gears are located between the outer sides of the transverse plates (21)(22) and cover (20). Two idle gears (41)(42) are additionally installed in the square slot, and they are connected with gears (101)(102)(103) as shown in FIG. 3, so that a gear system is formed.

Figure 4:
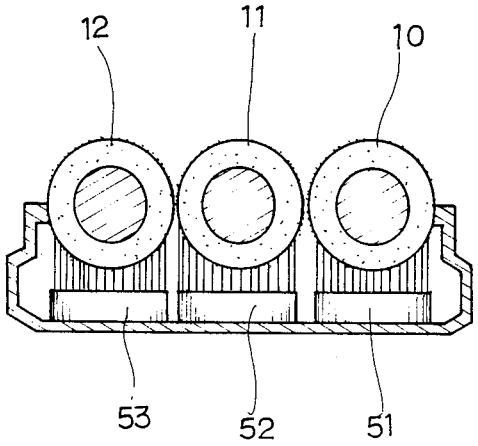
FIG. 4 is a view of the rollers and the brushes in the present invention.

Plates (51)(52)(53) are installed on the bottom side of base (30) corresponding to the positions of the three rollers (10)(11)(12). The brushes are installed on each of the plates. The end of each brush forms a circular arc in the same circular manner as the outer circle of the roller, and the ends of the brushes are contacted with the bottom part of the rollers as shown in FIG. 4.

Figure 3:
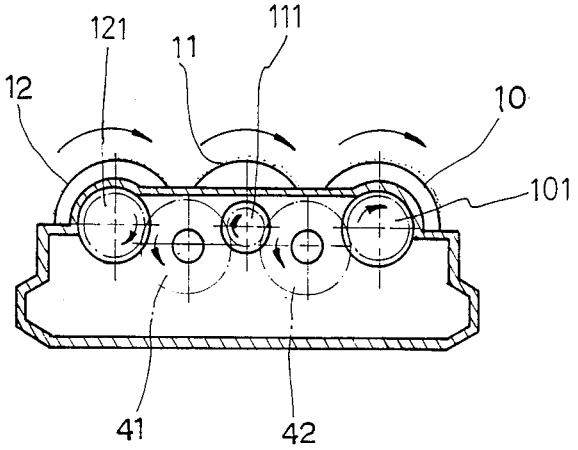
FIG. 3 is a plan view of the transmission of the gear system in the present invention.

As shown in FIG. 3, when the rollers are rotating, during the erasing of the blackboard, in the direction of the arrow, the gear (121) rotates in the positive direction and drives the first idle gear (41) to rotate in the reversed direction. The first idle gear (41) rotating in the reversed direction drives the gear (111) to rotate in the positive direction. Similarly, the second idle gear (42) will rotate in the reversed direction, and the gear (111) rotates in the positive direction. Therefore, the rotational directions of gears (101)(111)(121) are the same in spite of the erasing direction. Because the number of the teeth of the second gear (111) is less than the first and the third gears (101)(121), the second gear (111) has higher rotational speed. Therefore, the rotational speeds of the rollers (10)(11)(12) are different. Using this speed difference, the friction force between blackboard and the eraser is also different, so that the chalk dust on the blackboard can be thoroughly erased. Moreover, when the rollers (10)(11)(12) are rolling for erasing the chalk dust, the brushes (51)(52)(53) located under the rollers (10)(11)(12) are erasing the chalk dust on the rollers (10)(11)(12), so that the rollers (10)(11)(12) can always clear for erasing the blackboard.

I claim:

1. A blackboard eraser which comprises a housing, a base (30), at the bottom of said housing, at least three plates located on said base, at least three brushes placed on said plates, at least three roller (10), (11), (12), rotatably mounted in said housing and having sponge on their surfaces, each roller positioned to contact one of said brushes, the rollers having an axle, a gear system comprising a pair of first gears at the ends of the axle of each roller, a pair of idle gears connected to said first gears at one end of said rollers, the gears connected to one of said rollers having a number of teeth smaller than the number of the teeth of the gears connected to the other two rollers, whereby the rollers have different transmission speed.

2. The blackboard eraser according to claim 1 wherein each of the brushes is arcuated to follow the circular outline of each of the rollers.

* * * * *